US007833619B2

(12) United States Patent
Frantellizzi

(10) Patent No.: US 7,833,619 B2
(45) Date of Patent: Nov. 16, 2010

(54) DROPCLOTH

(76) Inventor: Mark Frantellizzi, 28 Old Dock Rd., Kings Park, NY (US) 11754

( * ) Notice: Subject to any disclaimer, the term of this patent is extended or adjusted under 35 U.S.C. 154(b) by 417 days.

(21) Appl. No.: 11/766,064

(22) Filed: Jun. 20, 2007

(65) Prior Publication Data

US 2008/0313971 A1 Dec. 25, 2008

(51) Int. Cl.
*B32B 27/00* (2006.01)

(52) U.S. Cl. ..... 428/220; 428/195.1; 428/81; 428/52; 2/159; 2/161.8; 2/167

(58) Field of Classification Search ..... 428/220, 428/195.1, 81, 52; 2/159, 161.8, 167
See application file for complete search history.

(56) References Cited

U.S. PATENT DOCUMENTS 2,167,226 A * 7/1939 Wells et al. ..... 2/159
3,227,574 A * 1/1966 Mohr ..... 428/96
5,227,214 A * 7/1993 Kerr et al. ..... 428/95
5,948,707 A * 9/1999 Crawley et al. ..... 442/101
6,709,728 B2 * 3/2004 Kerr et al. ..... 428/47
2002/0004114 A1 * 1/2002 Leaphart et al. ..... 428/36.1
2004/0025224 A1 * 2/2004 Albert ..... 2/159
2005/0014433 A1 * 1/2005 Langley et al. ..... 442/76

OTHER PUBLICATIONS

A&B Wiper Supply: <http://web.archive.org/web/2OO30802060603/bestrags.com/painting.html>, publication date Aug. 2, 2003.*
Fiber-Lok Rug Backing: <http:/ /www.save-on-crafts.com/rugbacbrfibl.html>, Oct. 18, 2002.*
Jiffy Grip: <http:/www.save-on-crafts.com/jifgripbrnon.html>, Oct. 2, 2002.*

* cited by examiner

*Primary Examiner*—David R Sample
*Assistant Examiner*—Lawrence D Ferguson
(74) *Attorney, Agent, or Firm*—Lillie Law, LLC; James J. Lillie

(57) ABSTRACT

An improved dropcloth comprising: a body made from a material having a desired shape and weight, said body having a plurality of surfaces wherein at least one surface has a slip reducing feature.

19 Claims, 3 Drawing Sheets

DROPCLOTH

BACKGROUND OF THE INVENTION

This invention relates to a dropcloth, in particular, an improved dropcloth that includes, inter alia, a slip reducing feature.

Historically, dropcloths have been used by painters, whether professionals, or do it yourselfers, in either case, to protect surfaces of various materials, inter alia, such as metal, plastic, tile, and wood, whether walls, flooring, and/or furniture from fugitive drips. The basis for such usage is primarily driven to eliminate the need to repair and/or replace such surfaces, by merely incurring the cost of efforts of deploying a dropcloth in the work zone.

However, one issue of many exists in the work zone, which is primarily encountered by the worker who needs to walk around on top of the deployed dropcloth, namely, slippage. This is experienced at times, when the worker is standing on a ladder and leans side to side, or out forwards or backwards and the ladder moves relative to the flooring due to the dropcloth, although the more common occurrence of slippage is when the worker walks about the dropcloth, wherein the interface between the dropcloth and flooring does not remain static, thereby contributing to the worker's injury. This issue is only further exacerbated when the work zone includes or encompasses a stair case. The safety of the worker is key, and when the stair case has a slick surface, e.g., hard wood, a dynamic interface is almost inevitable between the underside of the dropcloth and the topside of the flooring when a worker walks about the dropcloth, and due to the nature of staircases, the probability of injury incurred by failing and the severity of the injury is greatly increased. In this regard, there is a need for a slip reducing dropcloth.

SUMMARY OF THE INVENTION

The present invention is directed to an improved dropcloth having the primary advantage of increased safety by providing slip reducing features.

Other objectives, advantages, and novel features of the present invention will become more apparent from the following detailed description when taken in conjunction with the accompanying drawings.

BRIEF DESCRIPTION OF THE DRAWINGS

The following drawings, in which like reference characters indicate like parts, are provided for illustration of the invention and are not intended to limit the invention in any manner whatsoever.

DETAILED DESCRIPTION OF THE INVENTION

Figure 1:
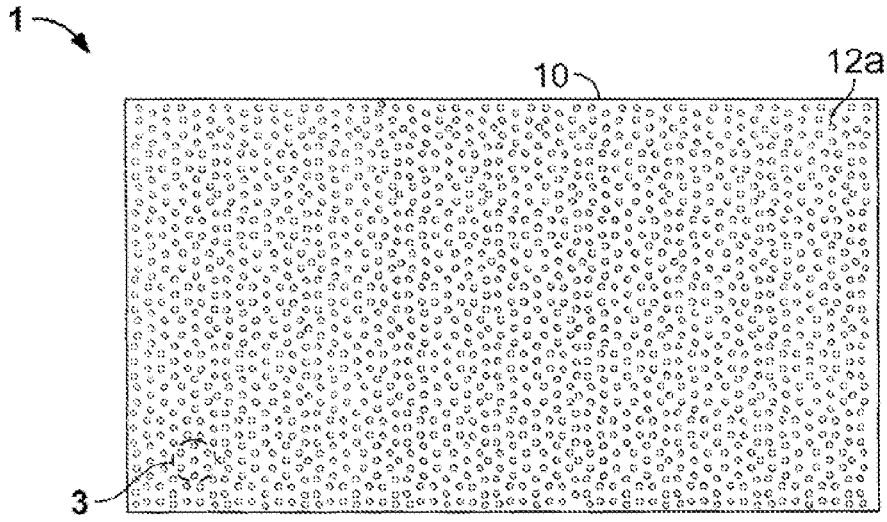
FIG. 1 illustrates a front view of the preferred embodiment.
Figure 2:
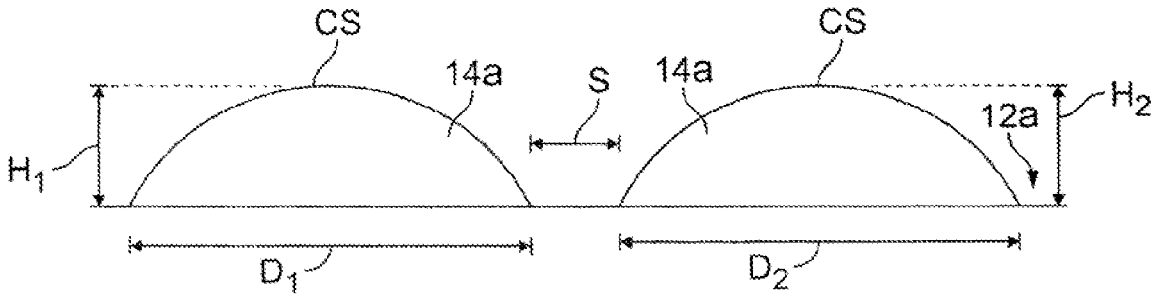
FIG. 2 illustrates a side view of the preferred embodiment.

The following descriptions of the preferred embodiments are presented to illustrate the present invention and are not to be construed to limit the claims in any manner whatsoever. In reference to the drawings, namely FIGS. 1 to 6, the preferred embodiment of the present invention is disclosed, which is directed to an improved dropcloth 1 comprising: a body 10 made from a material having a desired shape and weight, such as a square, rectangle, triangle, circle, oval, or other practical shape, common sizing includes but is not limited to 10'×12', 9'×12', or even a stair blanket having the approximate dimensions of 3'9"×14'9". Nonetheless, FIG. 1 exhibits a more common shape, namely, a rectangle. Said body 10 having a plurality of surfaces 12*a*, 12*b* wherein at least one surface 12*a* has a slip reducing feature 14 wherein said body 10 is made from a material comprising cotton, polyester, and rayon taken alone, in any combination thereof, or along with another material commonly known in the industry, wherein said material is machine washable.

The dropcloth 1 is made from a material having a weight in the range of about four (4) to sixteen (16) ounces per square yard fabric weight prior to infusion, although it is preferred to be made from a material having a weight in the range of about eight (8) to ten (10) ounces per square yard fabric weight prior to infusion.

Figure 5:
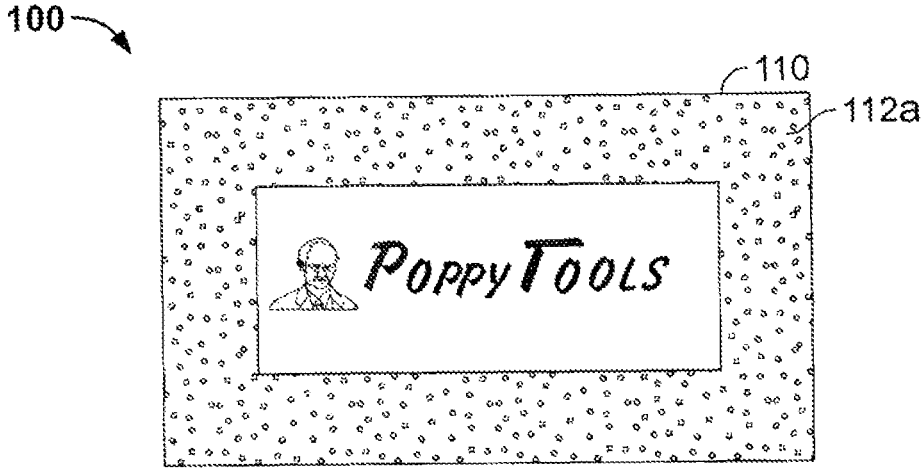
FIG. 5 illustrates a front view of an alternative embodiment.
Figure 6:
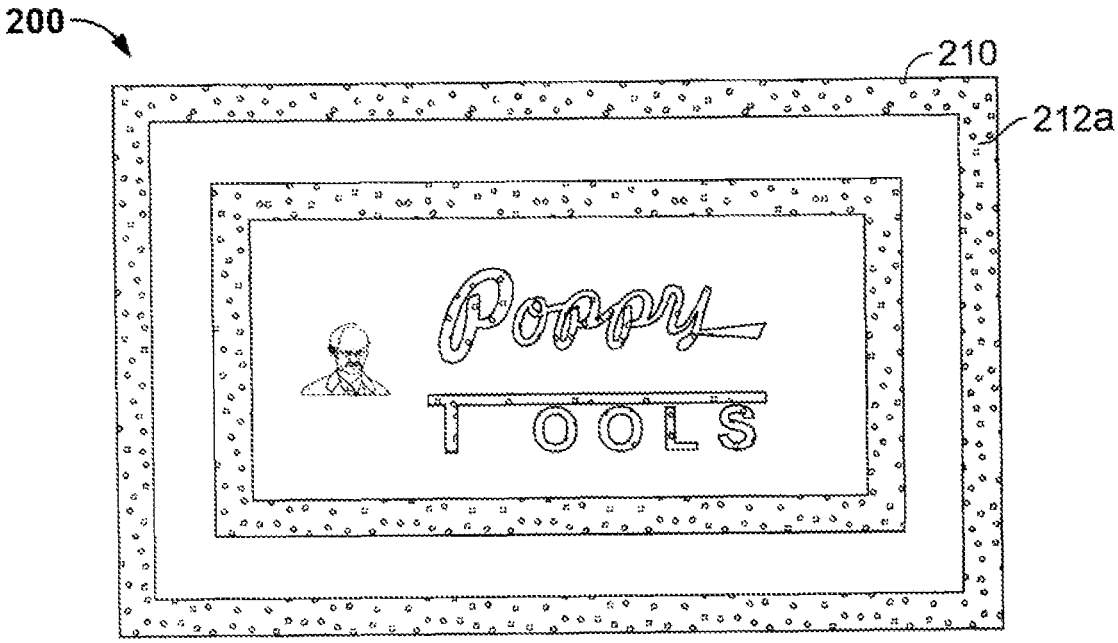
FIG. 6 illustrates a front view of an alternative embodiment.

The slip reducing feature 14 comprises a non-linear contoured topographical surface, both from a side and top view perspective, wherein such top view perspective is illustrated in FIGS. 1, 5, and 6, such as dot technology, wherein each dot 14*a* has a center C, a diameter D, a height H, a contact surface CS, and a space S between each dot, wherein the spacing between each dot 14*a* varies, as illustrated in FIG. 1.

FIG. 5 illustrates FIG. 1 modified to the extent of fewer dots per square inch but with the center portion of the surface 12*a* having dots arranged in a picture and a slogan, e.g., a pattern having one more on more alphanumeric characters, and designs or combination thereof.

FIG. 6 illustrates a further iteration, with the border trifurcated, that is, the middle section of the border is dotless, and the center portion of surface 12*a* comprising dots arranged in a picture-like image and layout of a slogan.

The material is infused with said feature 14, although it is envisioned that other shapes maybe used, e.g., stars, squares, or other polygons having a contact surface CS that is either smooth or non-smooth, i.e., the CS is topographical itself, wherein the contact surface CS is defined as the surface of the dot that ultimately interfaces with the desired work surface, e.g., floor, furniture, staircase etc., as this promotes the looseness, malleability of the dropcloth to conform to the shape of the object(s) it is covering, for example, a staircase has risers, runners, along with the stringers, this is a three-dimensional object and the dropcloth needs to emulate for optimization of egress for the end user, i.e., to identify where the steps are to navigate accordingly. Thus, by having the feature 14 limited to the surface of the dot, and not the space therebetween, the dropcloth is more malleable.

The slip reducing feature 14 is made from polyvinylchloride, rubber, or material having similar properties of a product called KEVLAR® (hereafter KEVLAR), taken alone or in any combination thereof, or with any other common material known in the industry, wherein KEVLAR® is the registered trademark for a light, strong para-aramid synthetic fiber, related to other aramids such as Nomex and Technora.

Developed at DuPont in 1965 it was first commercially used in the early 1970s as a replacement for steel in racing tires. Typically it is spun into ropes or fabric sheets that can be used as such or as an ingredient in composite material components. Currently, KEVLAR® has many applications, ranging from bicycle tires and racing sails to body armor because of its high strength-to-weight ratio-famously: ". . . 5 times stronger than steel on an equal weight basis . . . " When KEVLAR® is spun, the resulting fiber has great tensile strength (ca. 3 620 MPa), and a relative density of 1.44. When used as a woven material, it is suitable for mooring lines and other underwater applications.

There are three grades of KEVLAR®: (i) KEVLAR®, (ii) KEVLAR® 29, and (iii) KEVLAR® 49. Typically, KEVLAR® is used as reinforcement in tires and rubber mechanical goods. KEVLAR® 29's industrial applications are as cables, in asbestos replacement, brake linings, and body armor. KEVLAR® 49 has the greatest tensile strength of all the aramids, and is used in plastic reinforcement for boat hulls, airplanes, and bicycles. The ultraviolet light component of sunlight degrades and decomposes KEVLAR®, a problem known as UV degradation, and so it is rarely used outdoors without protection against sunlight.

Fibers of KEVLAR® consist of long molecular chains produced from PPTA (poly-paraphenylene terephthalamide). There are many inter-chain bonds making the material extremely strong. KEVLAR® derives part of its high strength from inter-molecular hydrogen bonds formed between the carbonyl groups and protons on neighboring polymer chains and the partial pi stacking of the benzenoid aromatic stacking interactions between stacked strands. These interactions have a greater influence on KEVLAR® than the van der Waals interactions and chain length that typically influence the properties of other synthetic polymers and fibers such as Dyneema. The presence of salts and certain other impurities, especially calcium, could interfere with the strand interactions and caution is used to avoid inclusion in its production. KEVLAR®'s structure consists of relatively rigid molecules which tend to form mostly planar sheet-like structures rather like silk protein.

For a polymer, KEVLAR® has very good resistance to high temperatures, and maintains its strength and resilience down to cryogenic temperatures (−196° C.); indeed, it is slightly stronger at low temperatures. At higher temperatures the tensile strength is immediately reduced by about 10-20%, and after some hours the strength progressively reduces further. For example at 160° C. about 10% reduction in strength occurs after 500 hours. At 260° C. 50% strength reduction occurs after 70 hours. At 450° C. KEVLAR® sublimates.

Figure 3:
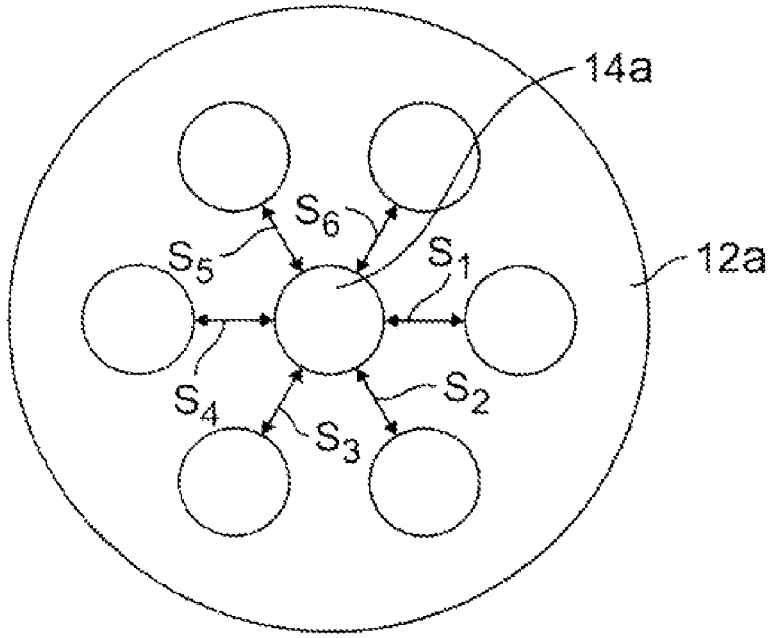
FIG. 3 illustrates a magnified view of a portion of FIG. 1.

In a preferred embodiment illustrated in FIG. 3, each dot 14 has a common diameter D (e.g., D1=D2) and a common height H (e.g., H1=H2), wherein said diameter D is about one-sixty fourths (1/64) of inch to about one-half (1/2) inch, and said height H is about one-sixty fourths (1/64) of inch to about three-eighths (3/8) of an inch.

Figure 4:
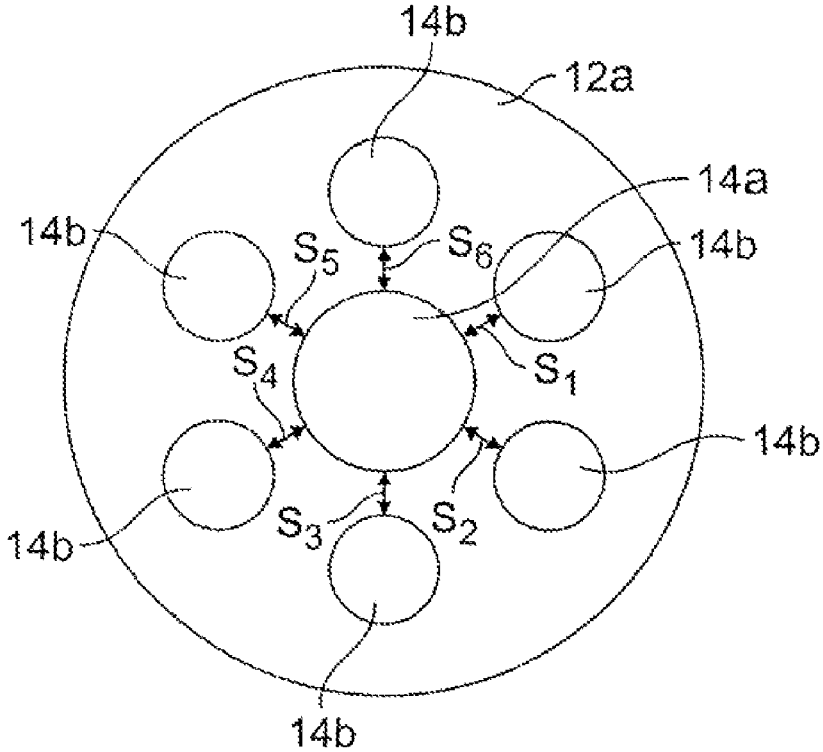
FIG. 4 illustrates a magnified front view of an alternative embodiment.

In an alternative embodiment illustrated in FIG. 4, said dots 14*a*, 14*b* have a plurality of common diameters D1≠D2, wherein dots 14*a* have diameter D1 and dots 14*b* have the diameter D2, wherein said diameters D1, D2 are about one/sixty fourths (1/64) of inch to about one-half (1/2) inch, and said height is about one-sixty fourths (1/64) of inch to about three-eighths (3/8) of an inch, but have a common height H (e.g., H1=H2). Whereas in a third embodiment (not shown), said dots 14*a* have a plurality of common heights H1≠H2 (e.g., H1=H3, and H2=H4, or e.g., H1=H4=H7, H2=H5=H8, and H3=H6=H9).

In a preferred embodiment, each dot 14*a* is spaced equidistant S1=S2=S3 etc., wherein each space S is about one-sixty fourths (1/64) of an inch to about one-half (1/2) inch. Although it is envisioned that there may be a plurality of spacing therebetween, e. g., S1≠S2≠S3 (e.g., non-equidistant or random spacing). Optionally, said dots 14*a* viewed collectively, form a pattern comprising a word, number, artistic design or combination thereof, such as PoppyTools™ or other slogan and/or company name as illustrated in FIGS. 5 and 6.

All of the above referenced patents; patent applications and publications are hereby incorporated by reference. Many variations of the present invention will suggest themselves to those of ordinary skill in the art in light of the above detailed description. All such obvious modifications are within the full-intended spirit and scope of the claims of the present application.

What is claimed is:

1. A dropcloth comprising: a body made from a material having a desired shape and weight, said body having a plurality of surfaces wherein at least one surface has a slip reducing feature, wherein said slip reducing feature is infused with said material and comprises a non-linear contoured topographical surface, wherein said slip reducing feature includes dot technology, wherein each dot has a center C, a diameter D, a height H, a contact surface CS, and space S between each dot, wherein each dot has a common diameter D and a common height H, wherein said diameter D is about one-sixty fourths (1/64) of inch to about one-half (1/2) inch, said height H is about one-sixty fourths (1/64) of inch to about three-eighths (3/8) of an inch, and wherein each dot is spaced non-equidistant.

2. A dropcloth as in claim 1, wherein said body is made from a material selected from the group comprising:

cotton, polyester, and rayon.

3. A dropcloth as in claim 1, wherein said body is made from a material having a weight in the range of about four (4) to about sixteen (16) ounces per square yard fabric weight.

4. A dropcloth as in claim 1, wherein said feature is made from a material selected from the group consisting of: polyvinylchloride, rubber, a light, strong, para-aramid synthetic fiber.

5. A dropcloth as in claim 1, wherein said contact surface is selected from the group consisting of smooth, and non-smooth.

6. A dropcloth as in claim 1, wherein said at least on surface forms a pattern comprising a word, number, artistic design, or combination thereof.

7. A dropcloth as in claim 6, wherein said material is machine washable, and each the shape of each dot is selected from the group consisting of star, triangle, square, rectangle, pentagon, hexagon, heptagon, octagon, and ellipse.

8. A dropcloth comprising: a body made from a material having a desired shape and weight, said body having a plurality of surfaces wherein at least one surface has a slip reducing feature, wherein said slip reducing feature is infused with said material and said feature includes dot technology, wherein each dot has a center C, a diameter D, a height H, a contact surface CS, and a space S between each dot, wherein said dots have a plurality of common diameters D1, D2 wherein D1≠D2, said diameters D1, D2 are about one-sixty fourths (1/64) of inch to about one-half (1/2) inch, said height H is about one-sixty fourths (1/64) of inch to about three-eighths (3/8) of an inch.

9. A dropcloth as in claim 8, wherein said body is made from a material selected from the group comprising:

cotton, polyester, and rayon.

10. A dropcloth as in claim 8, wherein said body is made from a material having a weight in the range of about four (4) to about sixteen (16) ounces per square yard fabric weight.

11. A dropcloth as in claim 8, wherein said feature is made from a material selected from the group consisting of: polyvinylchloride, rubber, a light, strong, para-aramid synthetic fiber.

12. A dropcloth as in claim 8, wherein said contact surface is selected from the group consisting of smooth, and non-smooth.

13. A dropcloth as in claim 8, wherein said at least on surface forms a pattern comprising a word, number, artistic design, or combination thereof.

14. A dropcloth as in claim 13, wherein said material is machine washable, and each the shape of each dot is selected from the group consisting of star, triangle, square, rectangle, pentagon, hexagon, heptagon, octagon, and ellipse.

15. A dropcloth comprising: a body made from a material having a desired shape and weight, said body having a plurality of surfaces wherein at least one surface has a slip reducing feature, wherein said slip reducing feature includes dot technology, wherein each dot has a center C, a diameter D, a height H, a contact surface CS, and a space S between each dot, wherein said dots have a plurality of common heights H1, H2 wherein H1≠H2, wherein said diameter D is about one-sixty fourths (1/64) of inch to about one-half (1/2) inch, and said heights H1, H2 are about one-sixty fourths (1/64) of inch to about three-eighths (3/8) of an inch.

16. A dropcloth as in claim 15, wherein said body is made from a material selected from the group comprising:

cotton, polyester, and rayon, said material having a weight in the range of about four (4) to about sixteen (16) ounces per square yard fabric weight.

17. A dropcloth as in claim 15, wherein said feature is made from a material selected from the group consisting of: polyvinylchloride, rubber, a light, strong, para-aramid synthetic fiber.

18. A dropcloth as in claim 15, wherein said contact surface is selected from the group consisting of smooth, and non-smooth.

19. A dropcloth as in claim 15, wherein said at least on surface forms a pattern comprising a word, number, artistic design, or combination thereof.

* * * * *